United States Patent [19]

Okumoto

[11] Patent Number: 4,640,168

[45] Date of Patent: Feb. 3, 1987

[54] APPARATUS FOR CUTTING CIGARETTES

[75] Inventor: Yutaka Okumoto, Musashino, Japan

[73] Assignee: Japan Tobacco Inc., Tokyo, Japan

[21] Appl. No.: 819,608

[22] Filed: Jan. 17, 1986

[30] Foreign Application Priority Data

Mar. 27, 1985 [JP] Japan ..... 60-060980

[51] Int. Cl.[4] ..... A24C 5/28

[52] U.S. Cl. ..... 83/677; 83/337; 83/340; 83/926 C

[58] Field of Search ..... 83/677, 337, 340, 174.1, 83/174, 310, 926 C, 672; 131/84 C

[56] References Cited

U.S. PATENT DOCUMENTS

| | | | |
|---|---|---|---|
| 1,992,722 | 2/1935 | Smith | 83/677 X |
| 2,464,108 | 3/1949 | Weisner et al. | 83/677 |
| 3,518,911 | 7/1970 | Niemann et al. | 83/338 |
| 4,517,871 | 5/1985 | Seragnoli et al. | 83/677 |

FOREIGN PATENT DOCUMENTS 20559 6/1977 Japan .

*Primary Examiner*—Frank T. Yost

*Attorney, Agent, or Firm*—Murray and Whisenhunt

[57] ABSTRACT

An apparatus for cutting a continuous bar of cigarettes into individual cigarettes includes a cutter head supported rotatably on a first rotary shaft, a knife projecting from the cutter head, and a device provided in the cutter head for holding and advancing the knife. A second rotary shaft is coaxial with the first rotary shaft. A gear train is provided between the first and second rotary shafts for rotating the second rotary shaft at a speed which is slightly different from that of the first rotary shaft. The knife advancing device includes a feed screw member which is rotatable by the second rotary shaft.

4 Claims, 10 Drawing Figures

APPARATUS FOR CUTTING CIGARETTES

BACKGROUND OF THE INVENTION

This invention relates to an apparatus for cutting a long intermediate product in the form of a continuous bar, for example, an intermediate cigarette product, into individual products, such as cigarettes. More particularly, it relates to such an apparatus including a cutter head supported rotatably on a rotary shaft, a knife projecting from the cutter head, and means provided in the cutter head for holding the knife and moving it to its cutting position.

There is known a machine which is used for making a long intermediate product in the form of a continuous bar and cutting it into individual products. A typical machine of this type is used for the manufacture of, for example, cigarettes. The quality of the cutting work is a matter of critical importance in the manufacture of cigarettes. The sharpness of a cut end surface is one of the important factors which determine the outward appearance of cigarettes. If a cigarette has an uneven cut surface, it prevents any satisfactory bonding of a filter tip thereto, or is automatically rejected during a gas permeability test. In either event, the production efficiency of the machine is lowered accordingly.

In a cigarette making machine, the cutting work is usually performed by an apparatus which comprises a cutter head supported rotatably on a rotary shaft, and a knife projecting from the cutter head. The knife is formed from a flat plate and has a cutting edge at its outer end. The knife is removably supported by a knife holder which is provided in the cutter head. The knife holder is provided with means for advancing the knife radially of the axis of rotation of the cutter head. The cutting edge lies on a segment of a curve having a progressively increasing distance from the axis of rotation of the cutter head, and has an eccentric contour along which it can progressively cut into a cigarette bar. When the knife is moved across a cigarette bar to cut a cigarette therefrom, its contact surface is shifted at the same speed as that at which the bar travels.

The knife is ground when it is in another position during its rotation. A grinding stone is disposed on the path of movement of the knife to grind its cutting edge. The grinding work not only means the grinding of the cutting edge, but also substantially defines its position relative to a cigarette bar. The work of advancing the knife makes up for the wear of its cutting edge which results from its cutting operation. In practice, the knife is advanced to a greater extent than is required to make up for the wear of its cutting edge, so that it may be forcibly ground to maintain a sharp edge.

The knife is usually advanced at a very low rate. A typical knife which cuts one cigarette during each rotation of the cutter head is advanced at a rate of 1.5 to 2 mm per hour when the cutter head is rotated at a speed of 2500 to 4000 rpm, and at a rate of, say, 3 to 3.5 mm per hour even if the cutter head may have a rotating speed of 5000 to 8000 rpm.

There have, however, been only a few technical proposals concerning the means for advancing the knife, and practically similar means have always been adopted. A typical known means for advancing the knife is shown in, for example, U.S. Pat. No. 3,518,911. It described two typical examples with reference to the drawings.

According to one of those examples, the cutting apparatus includes a knife for cutting a longitudinally traveling continuous cigarette bar, and a cutter head having an axis of rotation inclined at an angle to the longitudinal axis of the bar. This inclination gives the knife a component force of motion toward the bar. The cutter head is rotatably supported on a Cardan joint.

The knife holder is movable along a threaded pin which extends radially of the cutter head. The pin is rotatable about its own axis by a gear transmission mechanism and its input end is provided with a ratchet. A swing lever extends from the center of the rotary shaft about which the cutter head is rotatable, to the ratchet and is provided at one end with a pawl engaging the ratchet. A rod extends coaxially with the rotary shaft slidably therethrough and has one end connected to the other end of the lever. The other end of the rod faces the armature of an electromagnet so that the rod may be attracted whenever the electromagnet is energized. The swinging motion of the lever is transmitted to the gear transmission mechanism through the ratchet to rotate the threaded pin so that its screw motion may advance the knife.

According to the other example, a pawl is provided at one end of a rod extending coaxially and slidably through the shaft about which the cutter head is rotatable, and engages a ratchet to rotate a gear shaft of which the rotation is transmitted to a threaded pin. A worm and a worm screw are employed for advancing the knife. Further details of the apparatus of the type according to this example are shown in, for example, U.S. Pat. No. 3,176,560.

While the conventional apparatus as hereinabove described employs a Cardan joint for supporting the cutter head, it does not follow that only a Cardan joint can be employed in a cigarette cutting apparatus. It is true that the use of a Cardan joint is advantageous from the standpoint of, for example, altering the cut length of cigarettes, or positioning the grinding stone for the knife. In view of the importance of disposing the axis of rotation of the cutter head at an angle to the longitudinal axis of cigarettes, however, a cutting apparatus having an inclined shaft is already in practical use. The conventional apparatus having an inclined shaft or an inclined cutter head, however, employs for advancing the knife the means which does not differ from what is disclosed in the patent specifications as hereinabove referred to.

When the rod is attracted by the energized electromagnet, its axis displacement is transmitted to the ratchet through the lever or directly to rotate the threaded pin, though the rod can also be driven manually, or by a cam or any other appropriate mechanical device. The rotation of the ratchet is transmitted to the threaded pin through the gear transmission mechanism or directly and its screw motion advances the knife which is integrally held on a nut fitted about the pin. Alternatively, the rotation of the ratchet is transmitted to the worm screw for advancing the knife.

If the cutter head is rotated at a high speed, a large centrifugal force and a large force of inertia act on its elements, and the cutting of cigarettes or the grinding of the knife, for example, exerts on the cutter head an impact which resists its rotation to some extent. Therefore, a gradient of frictional resistance is taken into account in the selection of the screw thread, or worm which is used for advancing the knife. Neither the screw nor the worm, however, provides a sufficiently large ratio of speed reduction to achieve a very low rate which is desired for the advance of the knife.

Therefore, it has been usual to control the interval of energization of the electromagnet to, for example, one minute, to delay the advance of the knife, or provide a train of reduction gears between the ratchet and the threaded pin. According to the conventional apparatus, therefore, the knife is advanced substantially intermittently at a very low rate on the average so as not to create any impact when it is advanced. The knife appears to be continuously advanced and ground, but in substance, it is intermittently advanced to be brought into contact with the grinding stone, or cut a cigarette.

Although these features of the conventional apparatus have so far not caused any actual trouble, there is every likelihood of the knife receiving an unduly large impact upon contacting the grinding stone, or of a cigarette having an uneven cut surface. It is feared that an increase in the operating speed of the cutting apparatus may result in the actualization of any such trouble.

Moreover, if a train of reduction gears is employed for controlling the rate at which the knife is advanced intermittently, it adds to the number of the parts located in the cutter head and thereby increases the inertia on the rotating cutter head. This makes it difficult to rotate the cutter head at an increased speed. Such is particularly the case if the gear train is spaced apart from the center of the shaft about which the cutter head is rotatable.

SUMMARY OF THE INVENTION

It is an object of this invention to provide a cigarette cutting apparatus having a knife which can be advanced at a very low rate continuously.

It is another object of this invention to provide a cigarette cutting apparatus which includes only a very small number of parts in a cutter head, while enabling a knife to advance at a very low rate without relying on any train of reduction gears, to reduce the inertia on the cutter head so that it may be rotatable at a high speed.

The apparatus of this invention is essentially characterized by including a second rotary shaft which is coaxial with the shaft about which the cutter head is rotatable, means for rotating the second shaft at a speed which is slightly different from the rotating speed of the shaft about which the cutter head is rotatable, and means driven by the second shaft for advancing the knife.

More specifically, a train of gears which are rotatable at slightly different speeds from each other is provided between the two shafts, and a screw member which is rotatable at a speed proportional to the difference in rotating speed between the two shafts is provided in the cutter head so that it may engage the knife and drive it at a very low rate.

The two shafts are rotatable in the same direction and their rotating speeds have a very small difference therebetween. This difference is transmitted from the second shaft to the knife advancing member as an input force for rotating it. The knife advancing member may comprise a threaded pin of which the screw motion moves the knife forward as known in the art.

The gear train is disposed outside the cutter head and smoothly transmits continuous rotation from the shaft about which the cutter head is rotated, to the second rotary shaft. The second shaft is rotatable at a speed which is slightly different from that of the cutter head, and which enables the knife to advance at a very low rate. It is not necessary to provide any speed reducing device in the cutter head. Therefore, the cutter head is simple in construction, easy to assemble and small in weight. These features enable it to rotate at a high speed.

DETAILED DESCRIPTION OF THE INVENTION

Figure 7:
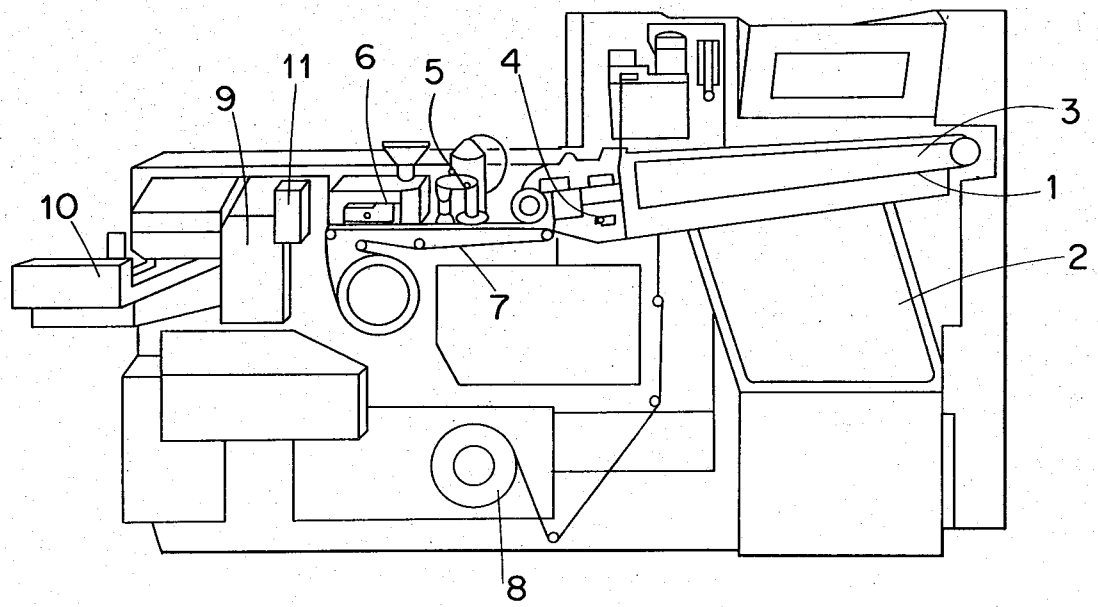
FIG. 7 is a schematic perspective view of a cigarette making machine.

Referring first to FIG. 7 of the drawings, there is shown a machine which is used for making cigarettes as will hereunder be described. Shred tobacco is conveyed in a stream of air up a chimney 2 and attracted to, and stacked on, the lower surface of a conveyor band 1 disposed below a suction chamber 3. The stacked tobacco is conveyed to the left as viewed in FIG. 7, and trimmed to an appropriate thickness by a trimming device 4. Then, it is transferred onto a web of paper 8 lying on a tape of cloth 7, and wrapped therein. A paste is applied to a margin of the paper 8 by a paste applicator 5 and fixed by a heater 6, whereby a continuous bar 20 of cigarettes is formed. Then, the bar 20 is passed into a radiation density detector 11 in which its filling density is examined, and cut into individual cigarettes 21 by a cutting apparatus 9. The cigarettes 21 are received on a conveyor 10 and transferred to another station.

Figure 5:
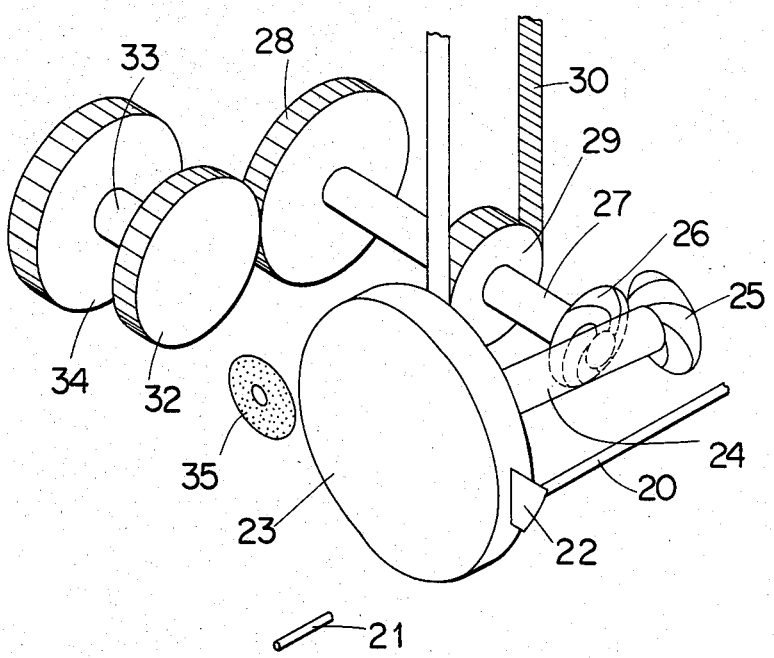
FIG. 5 is a schematic perspective view outlining the construction of the apparatus shown in FIG. 1*a;*

The cutting apparatus is usually constructed as schematically shown in FIG. 5. It includes a knife 22 for cutting the bar 20 into the individual cigarettes 21 having a predetermined length. As the bar 20 is formed continuously at a constant speed, it is necessary for the knife 22 moving across the bar 20 to be able to follow the movement of the cross sectional plane of the bar 20 at the same speed. Therefore, a cutter head 23 is rotatably supported on a shaft 24 disposed at an angle to the longitudinal axis of the bar 20. The knife 22 is supported by the cutter head 23 and projects from its outer peripheral surface, so as to move in a plane perpendicular to the longitudinal axis of the bar 20. The knife 22 is disposed at an angle to the cutter head 23 and its angle thereto is equal to the angle at which the shaft 24 is inclined to the bar 20.

This inclination ensures the cutting of each cigarette 21 in a plane perpendicular to its longitudinal axis, and a horizontal component of velocity for the movement of the knife 22 following that of the bar 20. The angle of the inclination depends on the length of the cigarettes to be manufactured.

A bevel gear 25 is provided on the other end of the shaft 24 and meshes with another bevel gear 26. The bevel gear 26 is secured to a shaft 27 which is driven by a gear 28. A gear belt pulley 29 is secured to the shaft 27 and carries a gear belt 30 for driving a knife grinding device. A gear 32 meshes with the gear 28 for driving it. The gear 32 and a gear belt pulley 34 are coaxially provided on a shaft 33.

The gear 28, shaft 27, shaft 24, cutter head 23, knife 22 and knife grinding device 35 define an assembly which is rotatable over an appropriate angle about the longitudinal axis of the shaft 33. A point of cigarette cutting is always located on a line extending from the longitudinal axis of the shaft 33. Therefore, it is sufficient to select the angle of inclination of the shaft 24 to the bar 20 and the angle of inclination of the knife 22 to the cutter head 23 appropriately in accordance with the length of the cigarettes to be manufactured. It is easy to adapt the apparatus to any desired length of the cigarettes. The pulley 34 is connected to a main source of power not shown.

Figure 1A:
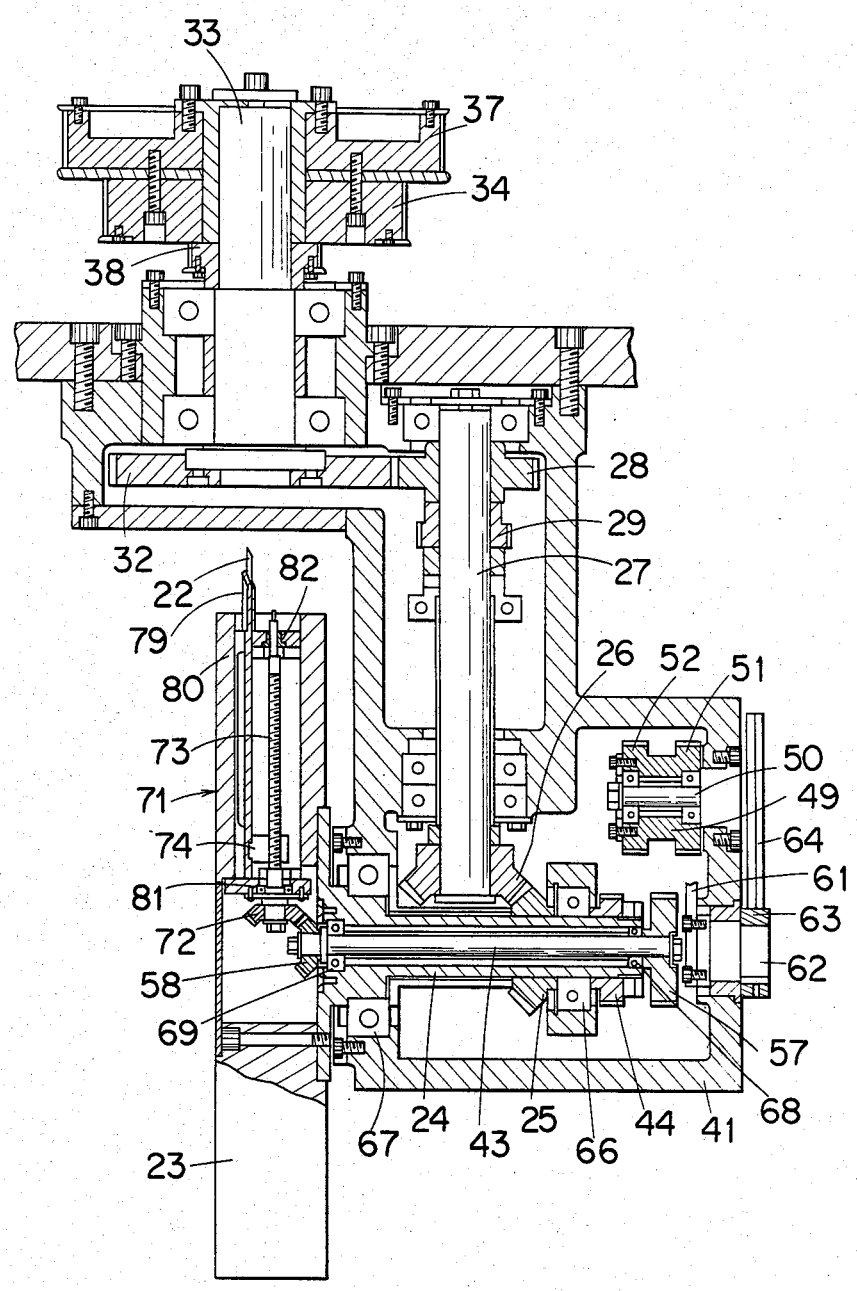
FIG. 1*a* is a fragmentary horizontal sectional view of an apparatus embodying this invention.
Figure 1B:
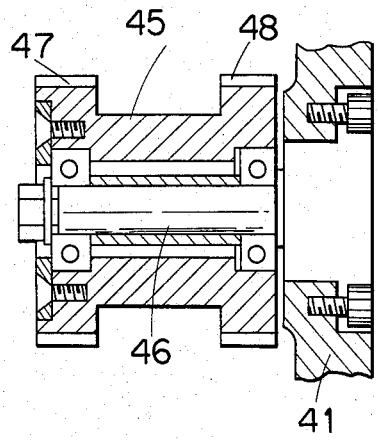
FIG. 1*b* is a longitudinal sectional view of a gear which is not shown in FIG. 1*a;*
Figure 1C:
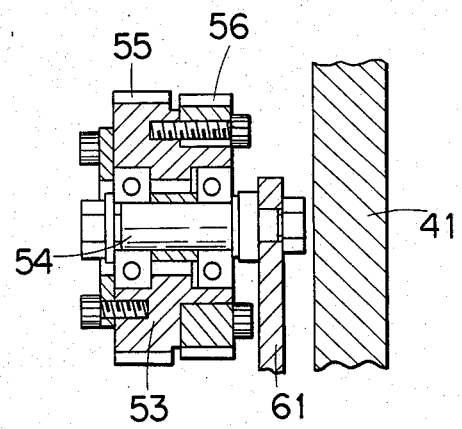
FIG. 1*c* is a longitudinal sectional view of another gear not shown in FIG. 1*a;*

An apparatus embodying this invention is shown in FIGS. 1*a* to 1*c*. FIG. 1*a* includes the various elements which have already been described with reference to FIG. 5. They are shown by the same numerals as those used in FIG. 5, and no repeated description is made. FIG. 1*a* also shows a gear belt pulley 37, a gear 38 and a variety of other elements, such as bearings, keys, brackets and screws, which do not form a part of this invention. They are all known in the art, and no further description thereof is made.

The shaft 24 about which the cutter head 23 is rotatable is a hollow shaft which is rotatably supported by bearings 66 and 67 on a frame 41. According to a salient feature of this invention, a second rotary shaft 43 is provided in the shaft 24 coaxially therewith and supported rotatably by bearings 68 and 69 disposed between the shafts 24 and 43. A gear 44 is secured to one end of the shaft 24 for transmitting rotation to a gear train 42, and a gear 57 is secured to one end of the second shaft 43 for receiving rotation from the gear train 42.

Figure 2:
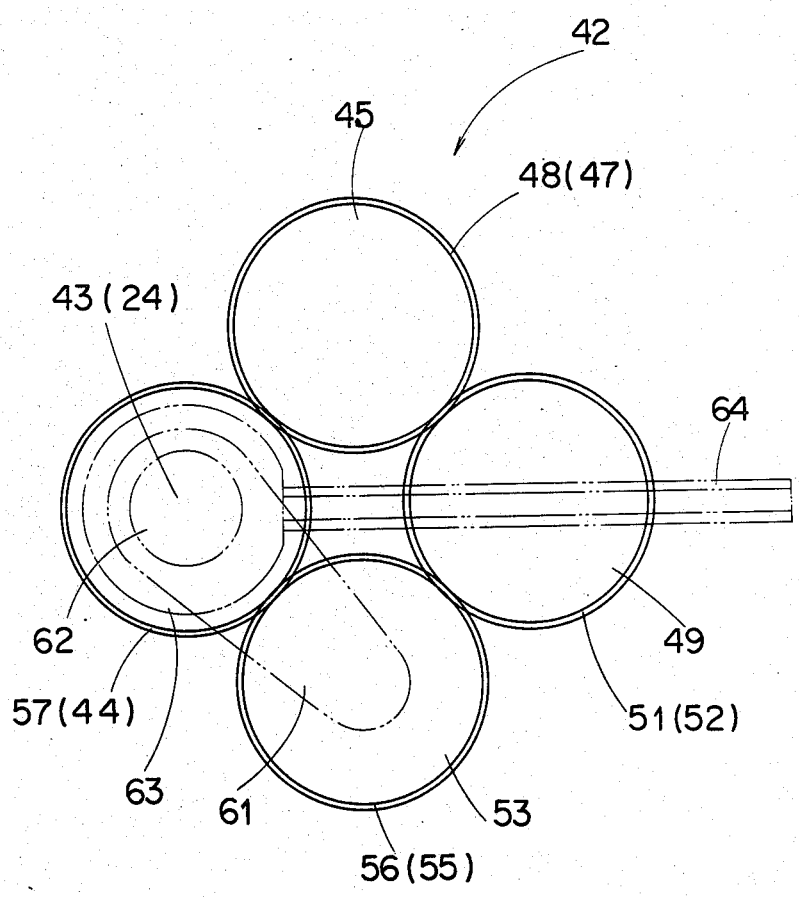
FIG. 2 is a side elevational view showing a train of gears appearing in FIGS. 1*a* to 1*c;*

The gear train 42 comprises a first intermediate gear member 45 (FIGS. 1*a* and 2), a second intermediate gear member 49 and a third intermediate gear member (FIGS. 1*c* and 2). The first intermediate gear member 45 includes an input gear 47 meshing with the output gear 44 on the shaft 24. It also includes an output gear 48 and is rotatably supported on a gear shaft 46 projecting from the frame 41. The second intermediate gear member 49 includes an input gear 51 meshing with the output gear 48. It also includes an output gear 52 and is rotatably supported on a gear shaft 50 projecting from the frame 41. The third intermediate gear member 53 includes an input gear 55 meshing with the output gear 52. It also includes an output gear 56 and is rotatably supported on a gear shaft 54 projecting from an arm 61. The output gear 56 meshes with the input gear 57 on the second shaft 43.

The gear train 42 is provided for establishing an appropriately small difference between the rotating speeds of the two shafts 24 and 43. In order to select an appropriate rotating speed for the second shaft 43, each of the gears forming the gear train 42 may, for example, have the following number of teeth. If the number of the teeth of the output gear 44 on the shaft 24 is expressed as N, N+1 may be the number of teeth on the input gear 47, 51 or 55 of each intermediate gear member 45, 49 or 53, and N+2 may be the number of teeth on the output gear 48, 52 or 56 of each intermediate gear member, while N+3 is the number of teeth on the input gear 57 of the second shaft 43.

The number N may, for example, be 65. If it is 65, the rotating speeds of the two shafts 24 and 43 have the following ratio:

$$N(N+2)^3/(N+1)^3(N+3)=1/1.0000068.$$

As this ratio has a significant bearing on the rate at which the knife is advanced, it is possible to alter the number N appropriately by considering certain factors, such as the means for advancing the knife and its grinding. It should, however, be noted that a very low rate which is empirically required for advancing the knife is achieved by a continuous force of rotation which is slightly different in speed from that of the shaft 24, and which is transmitted to the knife advancing means in the cutter head 23.

The gear train 42 can be disconnected easily to enable the readjustment of the knife advancing means 71 when the knife 22 is changed, as will hereinafter be described in detail.

The gear shaft 54 on which the third intermediate gear member 53 is supported projects from the arm 61 (FIG. 1*c*), and the arm 61 is secured to a shaft 62 supported rotatably on the frame 41 and rotatable about the axis of the shaft 62 (FIG. 1*a*). The shaft 62 is coaxial with the second rotary shaft 43 and the third intermediate gear member 53 is rotatable about the axis of the shaft 43 for engagement with, or disengagement from, the second intermediate gear member 49. A bracket 63 is secured to the shaft 62 and a lever 64 is provided for effecting such engagement or disengagement, as shown in FIG. 2.

A bevel gear 58 is secured to the opposite end of the rotary shaft 43 from the shaft 62 and projects into the hollow interior of the cutter head 23 which is integrally connected to the rotary shaft 24. The cutter head 23 is basically a cylinder having a small axial length and accommodates the knife advancing means 71. The cutter head 23 may be hollow except its portions in which the various parts are disposed.

Figure 3:
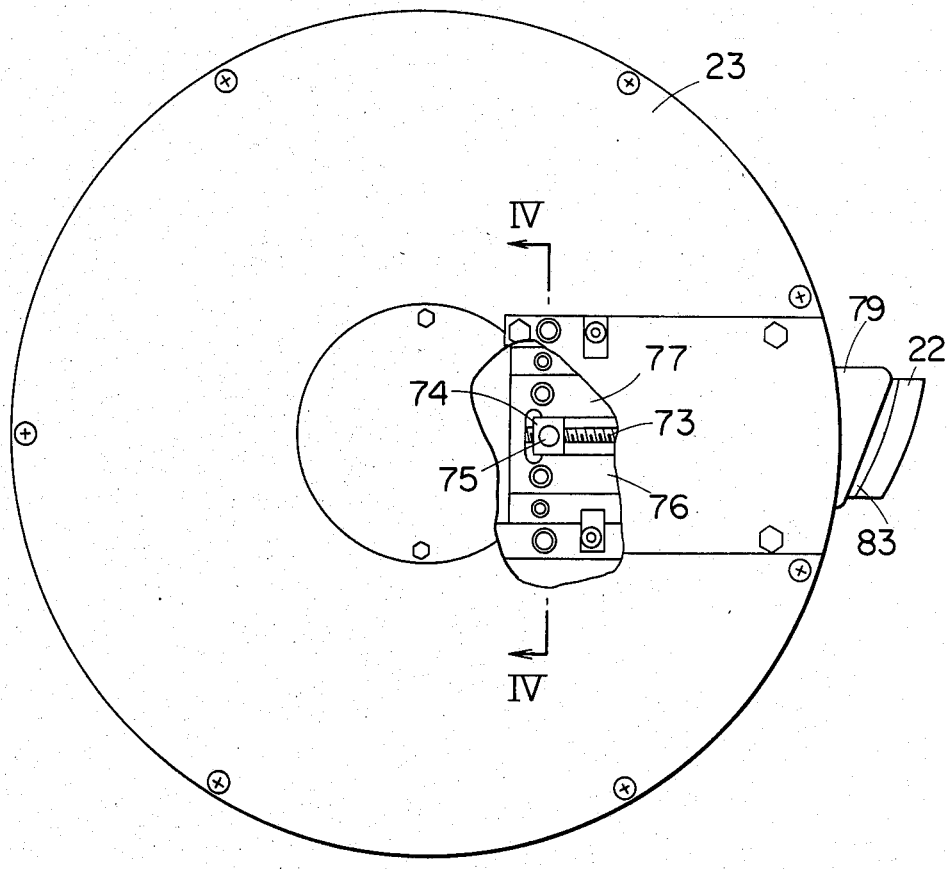
FIG. 3 is a side elevational view, partly in section, of the cutter head shown in FIG. 1*a;*
Figure 4:
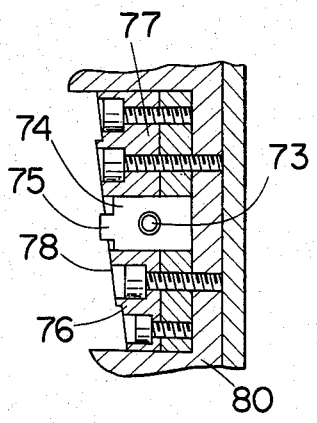
FIG. 4 is a sectional view taken along the line IV—IV of FIG. 3.

Referring to FIGS. 1*a*, 3 and 4, a bevel gear 72 meshes with the bevel gear 58, and a threaded pin 73 is secured to the bevel gear 72 and extends therefrom radially of the cutter head 23. The threaded pin 73 is rotatably supported on bearings 81 and 82 in a cutter head frame 80.

A knife holding member 74 is threadedly fitted about the pin 73 and movable along the pin 73 when it is rotated. A pair of guide members 76 and 77 are provided on the opposite sides of the knife holding member 74 for guiding its movement radially of the cutter head 23. The guide members 76 and 77 are not rotatable themselves, but have surfaces with which the knife holding member 74 is in sliding contact. The knife holding member 74 has a pin 75 for holding the knife 22.

One surface of the guide member 76 and an adjacent surface of the guide member 77 define a single knife guiding surface 78. The knife holding member 74 is disposed between the guide members 76 and 77 and the pin 75 projects through the knife guiding surface 78.

A knife guide 79 faces the knife guiding surface 78 and is spaced therefrom by a distance which is substantially equal to the thickness of the knife 22. The knife 22 is slidably held between the knife guiding surface 78 and the knife guide 79 and has a cutting edge projecting from the outer peripheral edge of the cutter head 23. A knife guiding plate 83 is provided for covering the end of the knife 22 except its cutting edge which is exposed. The knife 22 has a circular hole not shown at its base end and the pin 75 is removably fitted therein, so that the knife 22 can easily be connected to the knife holding means, or disconnected therefrom.

The knife guiding surface 78 lies at an angle to the plane in which the cutter head 23 is rotatable, as shown in FIG. 4. This arrangement ensures the movement of the knife 22 in a plane perpendicular to the longitudinal axis of the cigarette bar 20 when cutting it, and also imparts a horizontal component of velocity thereto.

Figure 6A:
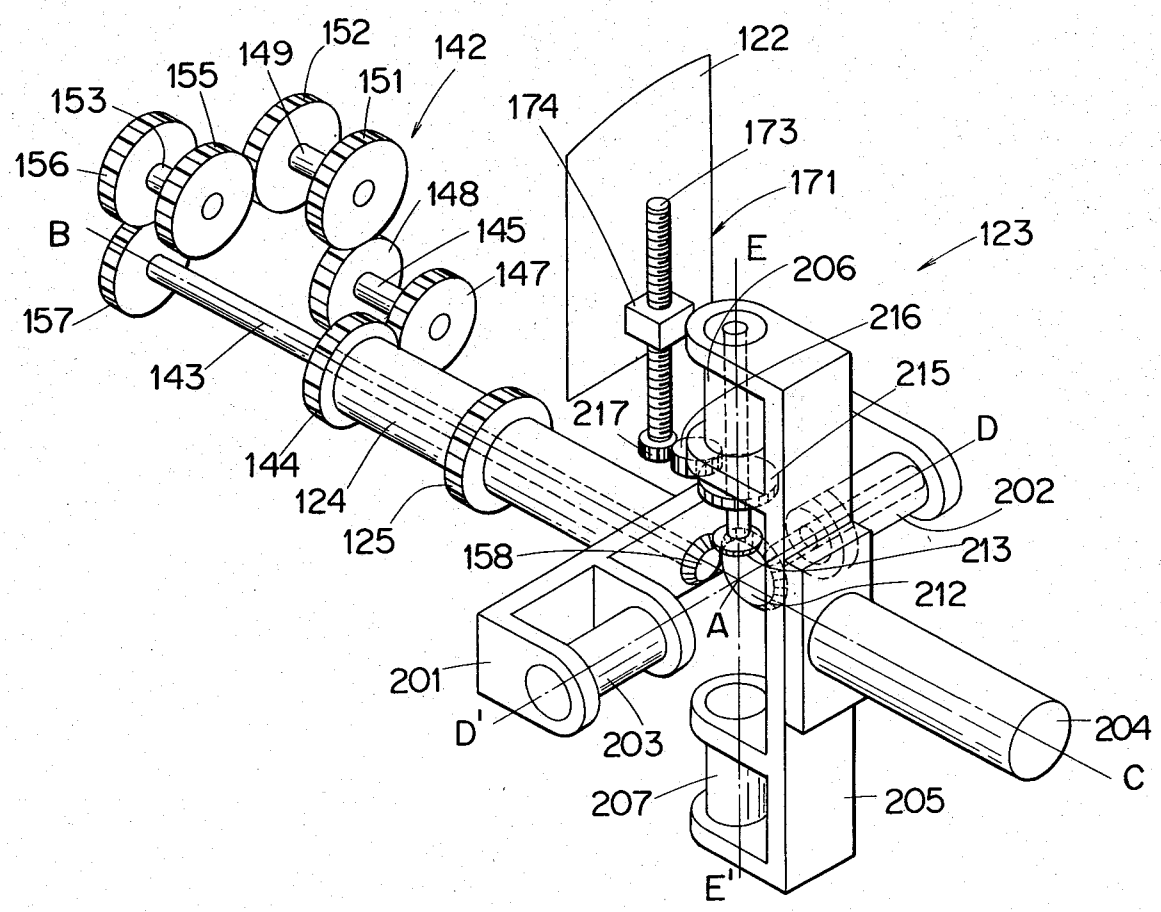
FIG. 6*a* is a fragmentary perspective view showing schematically the construction of an apparatus according to another embodiment of this invention.
Figure 6B:
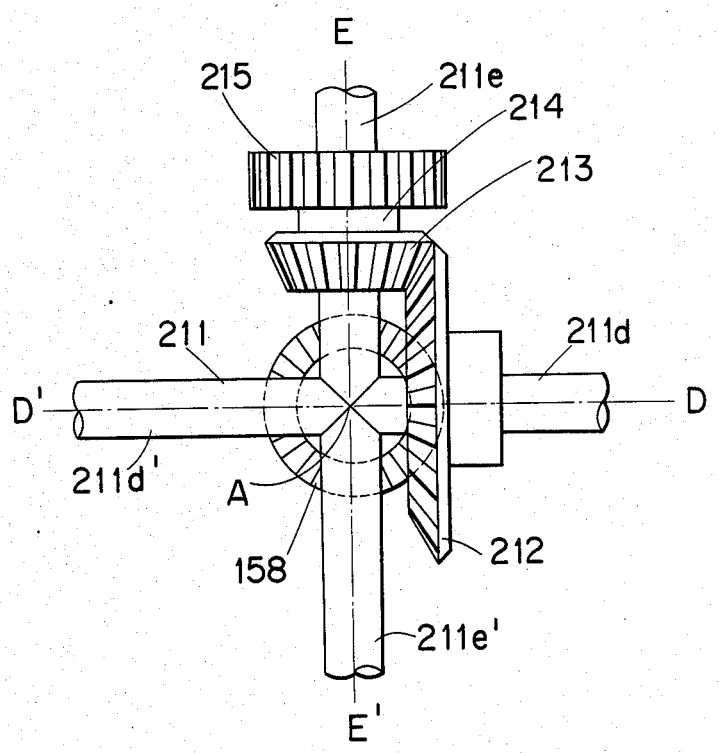
FIG. 6*b* a side elevational view of a cross shaft which is not shown in FIG. 6*a*, and some parts associated therewith.

Reference is now made to FIGS. 6*a* and 6*b* showing an apparatus according to another embodiment of this invention. This apparatus is basically of the type employing a Cardan joint as known in the art. No details of the joint will be described, as they are clear from, for example, U.S. Pat. Nos. 3,518,911 and 3,176,560. This embodiment of the invention is essentially characterized by including a cross shaft 211 defining a universal joint, as will hereinafter be described in detail.

A knife 122 is supported by a knife advancing device 171 on a frame, not shown, for a cutter head 123 rotatably about the axes AB and AC of rotation of the cutter head 123. The axis AB extends horizontally in parallel to the direction in which a continuous bar 20 of cigarettes travels. A horizontal shaft 124 has a longitudinal axis coinciding with the axis AB. The horizontal shaft 124 is provided for rotating the cutter head 123. The axis AC extends at an angle to the axis AB and meets it at point A. An inclined shaft 204 has a longitudinal axis coinciding with the axis AC. The inclined shaft 204 is a driven shaft for supporting the cutter head 123 during its rotation. The shaft 204 is supported in its inclined position by customary means not shown.

An axis DD′ extends through point A and is perpendicular to the axis AB. An axis EE′ extends through point A and is perpendicular to the axis AC. The axes DD′ and EE′ are perpendicular to each other. Two shafts 211*d* and 211*d*′ are located on the axis DD′ and two shafts 211*e* and 211*e*′ are likewise located on the axis EE′. The four shafts 211*d* to 211*e*′ define the cross shaft 211.

The horizontal shaft 204 is provided with an arm 201 at one end thereof adjacent to the cross shaft 211. Bearings 202 and 203 are provided at the opposite ends, respectively, of the arm 201 and axially aligned with the axis DD′. The inclined shaft 204 is provided with an arm 205 at one end thereof adjacent to the cross shaft 211. Bearings 206 and 207 are provided at the opposite ends, respectively, of the arm 205 and axially aligned with the axis EE′. The shafts 211*d*, 211*d*′, 211*e* and 211*e*′ are rotatably supported by the bearings 202, 203, 206 and 207, respectively. The horizontal shaft 124 is provided with gear 125 in its longitudinally middle portion. Power is transmitted from a power source not shown to the gear 125 to drive the shaft 124.

The horizontal shaft 124 is a hollow one. A second rotary shaft 143 is rotatably disposed in the shaft 124 and extends coaxially therethrough. The shaft 124 is provided at the other end thereof with an output gear 144 which is connected to a gear train 142. The second rotary shaft 143 is provided at its outer end with an input gear 157 which is connected to the output of the gear train 142.

The gear train 142 is identical in construction to the gear train 42 which has hereinbefore been described with reference to FIGS. 1*a* to 1*c*. In FIG. 6*a*, each constituent of the gear train 142 is shown by a numeral which is 100 greater than the number of its counterpart in FIG. 1*a*, 1*b* or 1*c*. Therefore, no further description of the gear train 142 is made.

The second rotary shaft 143 is provided with a bevel gear 158 at its inner end adjacent to the cross shaft 211. A bevel gear 212 is rotatably supported on the shaft 211*d* and meshes with the bevel gear 158. A gear member 214 including a bevel gear 213 and a gear 215 is rotatably supported on the shaft 211*e*. The bevel gear 213 meshes with the bevel gear 212. An intermediate gear 216 meshes with the gear 215 and a gear 217 meshes with the intermediate gear 216. The intermediate gear 216 can, however, be omitted, and the gear 217 can directly mesh with the gear 215.

The gear 217 is secured to the base end of a threaded pin 173 extending radially of the cutter head 123. A knife holding member 174 is threadedly fitted about the pin 173 and movable along the pin 173 when it is rotated. The knife advancing device 171 is substantially identical to its counterpart in the apparatus shown in FIGS. 1*a* to 4. Therefore, no further description thereof is made.

While the gear trains 42 and 142 have been specifically shown and described, it is to be understood that any other gear arrangement may be easily substituted therefor if it enables the transmission of a desired rate of rotation from the shaft about which the cutter head is rotatable, to the knife.

A modified gear train can, for example, be so designed that if the number of the teeth of the output gear on the cutter head shaft is designated as N, the input and output gears in each of the three intermediate gear members may have N−1 and N−2 teeth, respectively, while the input gear on the second rotary shaft has N−3 teeth. If N is 65, the rotating speeds of the two shafts have the following ratio:

$$N(N-1)^3/(N-1)^3(N-3)=1.0000078/1.$$

According to another possible arrangement, only a single gear member having an input gear and an output gear is disposed between the output gear on the cutter head shaft and the input gear on the second rotary shaft. If the output gear on the cutter head has N teeth, the input and output gears on the intermediate gear member may have N+1 and N+2 teeth, respectively, while the input gear on the second rotary shaft has N+1 teeth. If N is 65, the rotating speeds of the two shafts have the following ratio:

$$N(N+2)/(N+1)^2=1/1.0002296.$$

If, in the same arrangement, the output gear on the cutter head shaft has N teeth, the input and output gears on the intermediate gear member have N+1 and N teeth, respectively, and the input gear on the second shaft has N−1 teeth, and if N is 65, the rotating speeds of the two shafts have the following ratio:

$$N^2/(N+1)(N-1)=1.0002367/1.$$

What is claimed is:

1. In an apparatus for cutting cigarettes in a cigarette making machine, including a cutter head supported rotatably on a first rotary shaft, a knife projecting from said cutter head, and means provided in said cutter head for holding and advancing said knife, the improvement which comprises:

a second rotary shaft which is coaxial with said first rotary shaft;

a gear train provided between said first and second rotary shafts for rotating said second rotary shaft at a speed which is slightly different from that of said first rotary shaft; and said knife advancing means including a feed screw member adapted for rotation by said second rotary shaft.

2. An apparatus as set forth in claim 1, wherein said screw member is an externally threaded pin, said knife holding means being threadedly fitted about said pin and movable along said pin when said pin is rotated by said second rotary shaft.

3. An apparatus as set forth in claim 1, wherein said gear train comprises a first intermediate gear member having an input gear and an output gear, a second intermediate gear member having an input gear and an output gear, and a third intermediate gear member having an input gear and an output gear, said first rotary shaft having an output gear meshing with the input gear of said first intermediate gear member, said second rotary shaft having an input gear meshing with said output gear of said third intermediate gear member, wherein the combination of a gear ratio between the output gear of the first rotary shaft and the input gear of the first intermediate gear, a gear ratio between the output gear of the first intermediate gear member and the input gear of the second intermediate gear, a gear ratio between the output gear of the second intermediate gear member and the input gear of the third intermediate gear member and a gear ratio between the output gear of the third intermediate gear member and the input gear of the second rotary shaft is selected one of a first combination of N:N+1, N+2:N+1, N+2:N+1 and N+2:N+3 and a second combination of N:N−1, N−2:N−1, N−2:N−1 and N−2:N−3.

4. An apparatus as set forth in claim 1, wherein said gear train comprises an intermediate gear member having an input gear and an output gear, while said first rotary shaft has an output gear meshing with said input gear and said second rotary shaft has an input gear meshing with said output gear of said intermediate gear member, wherein the number of teeth on said output gear of said first rotary shaft and the number of teeth on said input gear of said intermediate gear member have a ratio of N:N+1 and the number of teeth on said output gear of said intermediate gear member and the number of teeth on said input gear of said second rotary shaft have a ratio of N+2:N+1 or N:N−1.

* * * * *